US006655100B1

(12) United States Patent
Andino

(10) Patent No.: US 6,655,100 B1
(45) Date of Patent: Dec. 2, 2003

(54) FRAMING ASSEMBLY AND METHOD FOR THE FORMATION OF A CURVED WALL OR LIKE STRUCTURE

(76) Inventor: Jose R. Andino, 2870 NW. 5$^{th}$ St., Miami, FL (US) 33125

( * ) Notice: Subject to any disclaimer, the term of this patent is extended or adjusted under 35 U.S.C. 154(b) by 0 days.

(21) Appl. No.: 09/834,860

(22) Filed: Apr. 16, 2001

(51) Int. Cl.$^{7}$ ..... E04B 1/32

(52) U.S. Cl. ..... 52/247; 52/85; 52/108; 52/245; 52/481.1; 52/717.03; 52/717.06; 4/513; 249/18

(58) Field of Search ..... 52/245, 246, 247, 52/717.03, 717.06, 85, 86, 481.1, 631, 108; 4/506, 513; 249/18, 155, 189

(56) References Cited

U.S. PATENT DOCUMENTS 2,197,318 A * 4/1940 Rumble
3,974,605 A * 8/1976 Beatty et al. ..... 52/169 R
4,566,141 A 1/1986 Mahoney
4,679,763 A 7/1987 Brotherton
5,137,251 A 8/1992 Jennings
5,155,872 A * 10/1992 Aymes ..... 4/506
5,291,717 A 3/1994 Turner
5,590,493 A 1/1997 Wilson
6,000,181 A 12/1999 Wheeler
6,094,877 A 8/2000 White
6,115,984 A * 9/2000 Paradis ..... 52/717.03
6,237,301 B1 * 5/2001 Paradis ..... 52/717.03

* cited by examiner

*Primary Examiner*—Carl D. Friedman
*Assistant Examiner*—Yvonne M. Horton
(74) *Attorney, Agent, or Firm*—Malloy & Malloy, P.A.

(57) ABSTRACT

A framing assembly and associated method of orienting and supporting a plurality of framing studs for constructing a curved wall through the utilization of a base formed of a high strength, flexible and at least partially separable material comprising a plurality of base segments which are disposed in interconnecting relation to spaced apart outwardly extending the sidewalls disposed in substantially parallel relation to one another. The plurality of base segments are removably secured to one another but are separable when the base is disposed in an operative position defined by a curved orientation which substantially corresponds to the curved wall or like structure being formed. The operative position is further defined by the plurality of base segments disposed in overlapping engagement with one another and an innermost one of the sidewalls separated into portions are overlapped and fixed so as to shorten the longitudinal dimension thereof and stabilize the framing assembly once the correct operative position of the base has been established.

14 Claims, 2 Drawing Sheets

FRAMING ASSEMBLY AND METHOD FOR THE FORMATION OF A CURVED WALL OR LIKE STRUCTURE

BACKGROUND OF THE INVENTION

1. Field of the Invention

A framing assembly used for the accurate placement and support of a plurality of framing studs in predetermined spaced relation to one another and collectively in a curved orientation which substantially corresponds to the curvelinear configuration of a wall or like structure being constructed.

2. Description of the Related Art

In the construction of walls, barriers or like structures which have a substantially linear configuration, a plurality of studs are typically oriented in predetermined spaced relation to one another and collectively in an elongated, substantially "coplanar" array. Conventional techniques used in the construction of straight walls are normally performed in a relatively short amount of time. Further, the forming of planar or linearly configured walls utilizing known construction techniques common to the building industry, normally do not require specialized labor and the framing assembly associated therewith can be constructed in a reasonable amount of time without requiring customization of any type of specialized framing apparatus.

To the contrary, the building of a curved wall, barrier, partition or the like and the mounting and orientation of the plurality of framing studs associated therewith is recognized in the building industry as being very time consuming and expensive. Problems associated with such curved wall construction exist, at least in part, due to the fact that the arcuate or curvelinear configuration of such structures are, by their very nature, not standardized or uniform. To the contrary curved walls vary in length and arc or radius of curvature.

Accordingly there is no consistently reliable apparatus or method which is universally recognized as facilitating the forming of curved walls or other structures by reducing the time involved and customization required in their construction. Further, due to the wide variety of curved structures prevalent in modern day architecture and building design, the depth and profile of such curve structures vary considerably. Such variance in the individual physical characteristics of curved walls and like structures have previously required that each individual structure be specifically planned and carefully erected. Also, the existence of a curved wall, barrier, etc. which includes a more complex curvelinear configuration further increases the amount of customization required as well as the time and trained personnel needed to effectively perform such construction.

The significance and extent of the problems and disadvantages associated with the building of a curved wall or like structure is further evident by the numerous attempts which have been made to develop an apparatus and/or method which allows a more efficient construction of a curved wall or the like. By way of example only, one known attempt involves the supplying of a support member in the form of a flexible band or strip with a series of adjacent tabs extending outwardly from one side of the band in perpendicular relation thereto. The plurality of tabs are spaced apart from one another and, due to the flexibility of the band or strip to which they are attached, the distance between the outwardly extending tabs may be greatly varied. The combined band and tabs are precisely arranged on a floor or other support surface on which the curved wall or like structure is to be built. A plurality of framing studs are secured to the band and tabs in an effort to collectively orient the framing studs in the desired curved configuration which corresponds to the intended curve of the wall, arc way or like structure being formed.

Devices and associated methods of this type, while generally assumed to be at least minimally capable of functioning in the intended manner do not significantly solve the long existing problems in the building and construction industry in that utilization of devices and/or assemblies of this type still require trained personnel and specific customization on the job site, Also the time and effort which must be devoted to each construction site is dependent on the specific physical characteristics of the curved wall or like structure being formed.

Other known and/or conventionally used apparatus for the formation of a curved wall include the use of mold-like assemblies formed from a plurality of mold segments which are collectively arranged into a preferred curvelinear configuration. This type of curved mold apparatus is primarily designed for the construction of walls or like structures utilizing a moldable material such as, but not limited to concrete, cement or the like. Accordingly, structures of this type are not readily adaptable for the building of curved walls, of the type typically found in domestic or commercial buildings.

Based on the above, there is an obvious and long recognized need for an assembly capable of effectively facilitating the formation of a plurality of framing studs in a preferred spaced apart curvelinear orientation, corresponding to the curved wall or other structure being formed. Such an improved framing assembly should require little or no customization once presented on the job site and should be capable of being applied to the positioning and mounting of the curved wall framing studs, by personnel without the need for exhaustive specialized training. Also, an improved framing assembly, of the type set forth above should be structured to include sufficient versatility to facilitate the formation of a variety of curved structures in addition to curved walls such as columns, barrier walls, partitions, archways, etc. Moreover, the framing associated with each of the previous types of curved structures should be capable of being easily assembled regardless of the complexity of the overall curvelinear configuration or the various curved segments or arcs extending along the length of and collectively defining the structure being formed.

SUMMARY OF THE INVENTION

The present invention is directed to an assembly and an associated method for framing a curved wall or like structure during its construction. More specifically, the framing assembly is structured to precisely locate and at least partially support a plurality of spaced apart studs defining the frame of the curved wall being formed. It is emphasized that the term "curved wall" as used herein in describing the structural details of the present invention is meant to include any type of substantially equivalent structure, such as but not limited to, a curved barrier, partition, etc. In addition, the framing assembly of the present invention and the method associated therewith is also readily adaptable, with minimal or no structural modification, for the formation of other structures incorporating a curved configuration. Such additional structures may include a column, arch way or the like. However, for purposes of clarity the term "curve wall" will be used to describe each of the similar structures of the type set forth above, all of which are intended to be within the spirit and scope of the present invention. In addition, the plurality of spaced apart studs used to form the curved wall or like structure are not, in and of themselves, necessarily to be considered a part of the present invention. Also it is of course noted that studs of the type used for framing the curved wall may be formed of wood, metal or any other applicable material commonly used in the construction industry.

Accordingly, the framing assembly of the present invention includes a base having an elongated configuration and comprising a plurality of base segments disposed in interconnecting relation to one another. In addition, the base includes two spaced apart sidewalls extending along the length thereof, wherein the sidewalls are interconnected to one another by attachment to correspondingly positioned peripheral portions of each of the plurality of base segments. When formed but not yet disposed in an operative position, as described in greater detailed hereinafter, the base segments and the two sidewalls are initially oriented in an elongated, linear array. Further the formation of the base can be accomplished using anyone of a variety of somewhat conventional manufacturing techniques. In at least one preferred embodiment, the base, including the plurality of base segments and the two sidewalls are integrally attached to one another. More over, in order to assure structural stability as well as the intended relative orientation of each of the plurality of base segments and sidewalls all, or at least a majority, of the base segments are interconnected to one another.

More specifically, when in the aforementioned nonoperative position each of the plurality of base segments are removably connected to the next adjacent base segment along corresponding peripheral edges or portions thereof. As set forth above, due to the preferred integral formation of the base each of the plurality of base segments may be secured to one another by a separable link. Alternatively the formation of each of the plurality of base segments may be such as to be removably attached or joined along corresponding peripheral edges in contiguous relation to one another. In either of the above noted embodiments, separation of predetermined ones or all of the plurality of base segments from one another is easily accomplished, such as by severing or otherwise separating the link or the contiguous joint between adjacent base segments, using conventional hand tools or of any other applicable means.

Similarly, the two sidewalls are integrally interconnected to each or at least a majority of the plurality of base segments by integrally formed links or alternatively by being attached along oppositely disposed peripheral portions of the plurality of base segments. Further, the two sidewalls are oriented so as to extend outwardly from a common side of the base segments in substantially parallel relation to one another. It is noted that the material from which the base, including the plurality of base segments and the two sidewalls, are formed as well as the manufacturing techniques used in the formation of the base may not facilitate a precise parallel orientation between the two sidewalls. However, as will be explained in greater detail hereinafter, the outward extension of the sidewalls in a substantially common direction serves to orient them in the aforementioned substantially parallel relation to one another. Positioning of the side walls in confronting engagement with spaced apart, oppositely disposed longitudinal surfaces of the plurality of studs which are being framed is thereby facilitated.

Further, in at least one preferred embodiment of the framing assembly of the present invention, the base including the plurality of base segments and spaced apart sidewalls are formed from a somewhat flexible but high strength metallic sheet material of relatively thin gauge. Such material demonstrates inherently desirable characteristics such as flexibility, high strength but yet can be easily separated, as by cutting, severing, etc., such as when the plurality of base segments are intended to be separated from one another, as set forth above. Therefore, due to the fact that the two sidewalls, as well as the plurality of base segments, are formed of a common, flexible, high strength material at least one, but preferably both of the sidewalls, demonstrate a sufficient flexibility to easily orient the base into the aforementioned operative position.

The referred to operative position may be more specifically defined by positioning the base into a curved orientation which substantially corresponds to the curvelinear configuration of the wall or other structure under construction. In doing so an inner most one of the two sidewalls will be oriented to assume a lesser radius of curvature and therefore a lesser longitudinal dimension than the outer most sidewall. However, the relative spaced positioning of the sidewalls to one another and to the plurality of base segments will be efficiently accomplished due to the fact that the two sidewalls are maintained in interconnected relation to one another by virtue of both of the sidewalls being connected to oppositely disposed peripheral portions of the plurality of base segments. In order for the base to assume the predetermined curved orientation corresponding to the curvelinear configuration of the wall or like structure being formed, the plurality of base segments extending along the curve will be disconnected from one another and will automatically assume a collective overlapping array. Moreover, the disposition of the base in the curved operative position force adjacent ones of the plurality of base segments into the overlapping relation to one another while maintaining the two sidewalls in substantially parallel, equally spaced apart orientation. In addition, the shortening of the innermost sidewall, in order to establish the required degree or radius of curvature thereof, is accomplished by separating a plurality of portions of the innermost sidewall from one another an reorienting these separated portions in an overlapping, fixed relation to one another.

In use, once the base is disposed in the aforementioned operative position the placement of the plurality of the spaced apart studs thereon may be easily accomplished. Accurate placement of the plurality of studs to collectively define the curved frame of the wall or like structure being formed will occur automatically by virtue of the mounting and/or attachment of a corresponding end of each of the plurality of studs to the base. More specifically, an end or extremity will confrontingly engage and/or be attached to one or more of the overlapping base segments. Concurrently the oppositely disposed longitudinal surfaces disposed in corresponding relation to the interior surfaces of the spaced apart sidewalls will establish a confronting engagement there between. Each of the studs may be accurately and securely attached, mounted on or supported by the base by virtue of the confronting engagement of each of the studs, in the manner set forth above, with one or more of the overlapping base segments as well as the spaced apart sidewalls.

It should be further noted that at least one embodiment of the present invention contemplates a separate base being attached to opposite ends of the plurality of spaced apart studs, such as by securing the plurality of framing studs to both a floor or like support structure or a ceiling, roof or oppositely disposed support structure.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
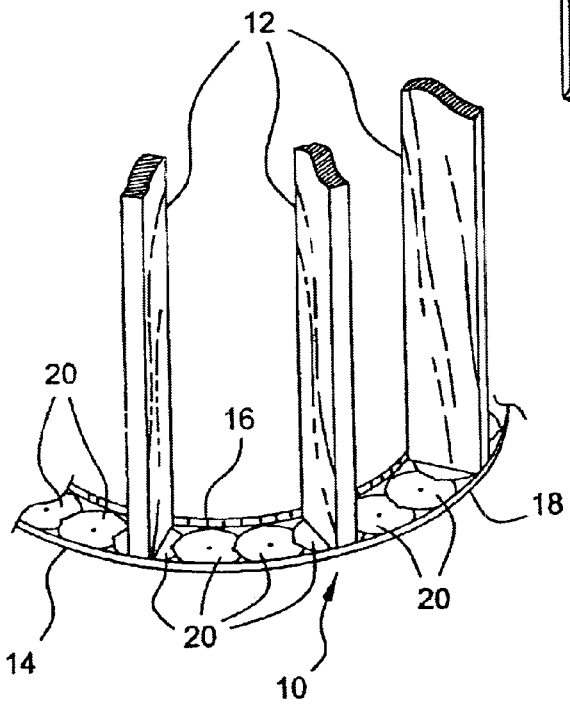
FIG. 1 is a perspective view in partial cutaway of a framing assembly of the present invention shown in an operative position.
Figure 2:
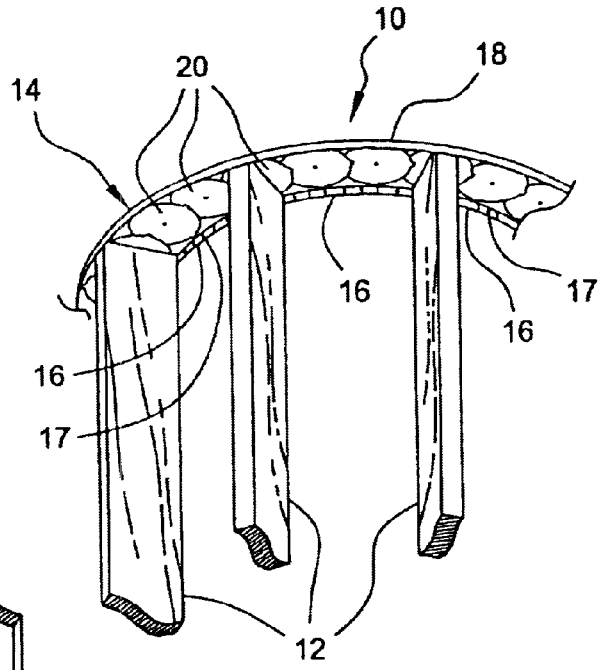
FIG. 2 s a perspective view in partial cutaway of the framing assembly of the present invention located in a different orientation during the formation of a curved wall or like structure.
Figure 3:
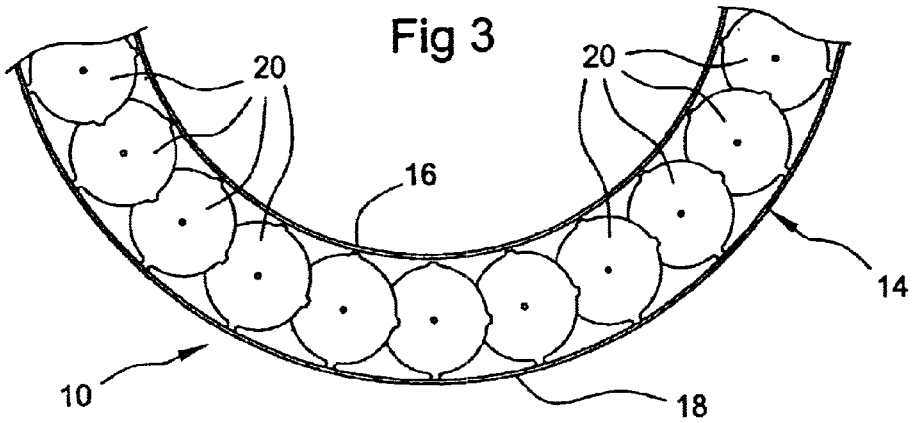
FIG. 3 is a top view of the framing assembly of the present invention in an operative position and being unattached to any framing studs.

As shown in the accompanying drawings, the present invention is directed towards an assembly generally indicated as 10 intended to be used in the construction of a curved wall or like structure to facilitate the framing of a plurality of studs 12 in spaced relation to one another. As such, the plurality of framing studs are collectively oriented in a preferred curved orientation which substantially corresponds to the curvature of the wall or other structure being formed. As shown in FIGS. 1 through 3 the framing assembly 10 is disposable in an operative position at least partially defined by its orientation along a curvelinear path which corresponds to the intended curvelinear configuration that the wall being constructed is intended to assume. Naturally, the degree or arc of curvature which the framing assembly 10 may assume when in the operative position may vary, thereby rendering it extremely versatile. Accordingly, a variety of significantly different curved structures may be formed using the framing assembly 10 due to such versatility. By way of example only, the framing assembly 10 may be used to form a substantially simple arc of curvature as demonstrated in FIGS. 1 through 3 or a more complex curvelinear configuration comprising an annular shape or a plurality of different arc segments interconnected to one another in a continuous manner or separated by and/or including linear segments.

Figure 6:
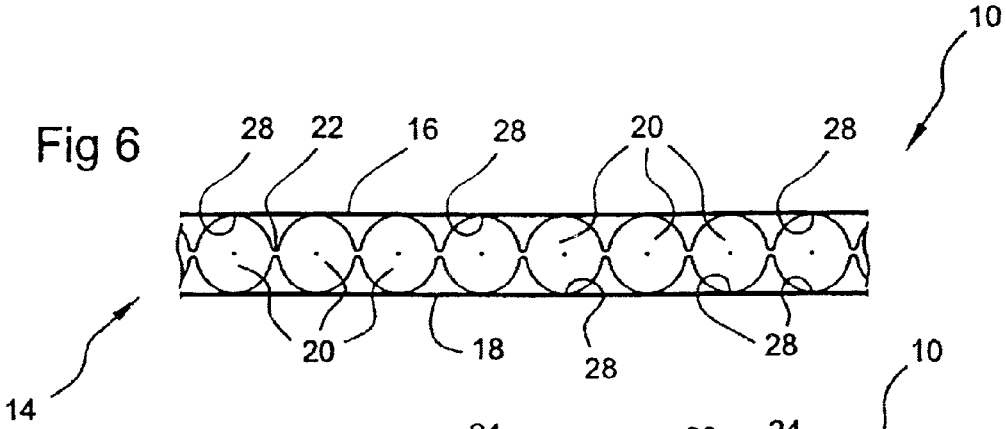
FIG. 6 is a top view of one preferred embodiment of the framing assembly of the present invention prior to being oriented in an operative position.
Figure 7:
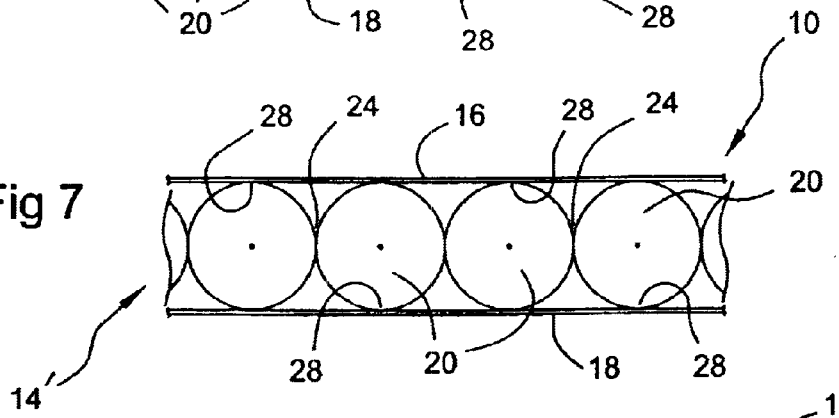
FIG. 7 is a top detailed view in partial cutaway of another embodiment of the framing assembly of the present invention.
Figure 8:
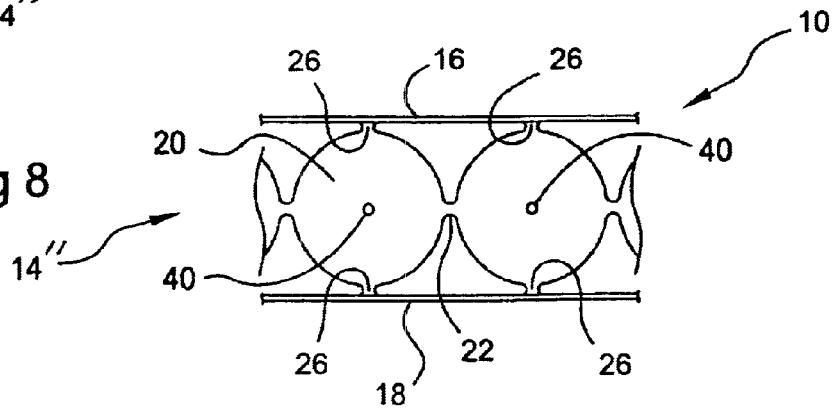
FIG. 8 is a is a top view in partial cutaway of yet another embodiment of the framing assembly of the present invention.

More specifically, the framing assembly 10 of the present invention comprises a base 14 which includes two spaced apart sidewalls 16 and 18 each being interconnected by a plurality of base segments 20. With reference to FIGS. 6 through 8, as initially formed the base 14 assumes an elongated substantially linear configuration, wherein each of the base segments 20 are connected to spaced apart sidewalls 16 and 18 along oppositely disposed peripheral portions thereof. In a preferred embodiment of the present invention the base 14, including the plurality of base segments 20 and the spaced apart sidewalls 16 and 18 are integrally secured to one another. As such, each or at least a majority of the base segments 20 are disposed in removable attachment to a next adjacent one of the base segments 20. Such removable or separable attachment between the plurality of base segments 20 can occur by an integrally formed link 22 and shown in FIGS. 6 and 8. Alternatively, the plurality of base segments 20 may be integrally joined along correspondingly disposed peripheral edges such that each of the base segments 20, or at least the majority thereof, are contiguously attached to one another as at 24, as disclosed in FIG. 7. Similarly, interconnection of the plurality of base segments 20 to the spaced apart sidewalls 16 and 18 may occur through the provision of a plurality of integrally formed links as at 26 and shown in FIG. 8. Also, the plurality of base segments 20 may be contiguously secured in integral fashion by substantially oppositely disposed peripheral edges as shown in FIGS. 6 and 7. Therefore, the various preferred embodiments of the base as indicated generally as 14, 14', and 14" differ from one another by the specific means of interconnection between the plurality of base segments 20 and/or attachment of the plurality of base segments 20 to the spaced apart sidewalls 16 and 18.

However, common to all of these embodiments is the fact that the base 14, and all of its components are formed from a high strength yet flexible material such as, but not limited to a thin gauge sheet metal. Further, a material from which each of the components of the bases 14, 14' and 14" are formed should be, at least in part, capable of being severed, cut or otherwise separated, such that at least some or all of the plurality of base segments 20 can be separated from one another when the base 14, 14' or 14" is oriented from the non-operative position, as shown in FIGS. 6 through 8, into the operative position as shown in FIGS. 1 through 3. It is of course noted that the primary distinction between the non-operative position of FIGS. 6 through 8 and the operative position of FIGS. 1 through 3 is the curved orientation assumed by the base 14 which corresponds to the intended curvelinear shape or configuration of the wall or like structure being formed.

The orientation of the base 14 into the operative position necessitates one of the two sidewalls 16 or 18 assuming an innermost position and a curved or arcuate configuration having a smaller radius of curvature than an outermost one of the sidewalls 18. For purposes of clarity the inner most sidewall will be designated as 16 and the outer most sidewall will be designated as 18 when the base 14 assumes the operative position of FIGS. 1 through 3. Clearly, in order that the inner most sidewall 16 is disposed along the curve segment or arc having a smaller radius of curvature, its longitudinal dimension must be shortened. Such is accomplished by forming the sidewall 16, as well as the remainder of the base 14, from a material which is separable such as, but not limited to, relatively thin gauge metallic sheet material.

Figure 5:
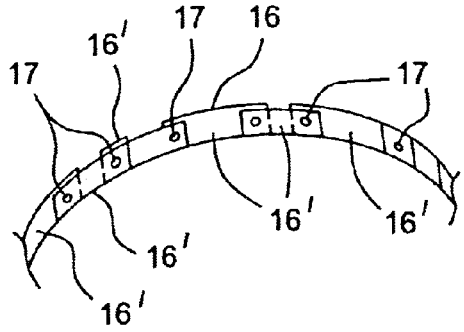
FIG. 5 is a perspective view in partial cutaway of a sidewall portion of the framing assembly of the present invention when oriented in an operative position.

Accordingly, an associated method of utilization of the framing assembly 10 and more specifically the base 14 comprises determining or establishing the specific curved orientation which the wall being formed is to assume. Once so established the inner most sidewall 16 is separated or severed at various spaced apart points along its length. With reference to FIG. 5, the separated portions 16' of the inner most sidewall 16 are then oriented in an overlapping relation to one another until the predetermined, shortened longitudinal dimension of the sidewall 16 has been achieved. Once the intended longitudinal dimension of the sidewall 16 has been achieved, the separated portions 16' are fixedly connected to one another by applying any of a variety of different connectors or fasteners. Alternatively, the crimping or affixing the overlapping portions of the segment 16' to one another as at 17 may be accomplished by using anyone of a variety of hand tools, including a hand operable crimping tool or the like. The outermost sidewall 18, being formed of the aforementioned at least partially flexible sheet material, naturally assumes the intended curved orientation maintaining a substantially equally spaced apart relation to the inner most sidewall 16.

The operative position of the framing assembly 10 and more specifically the base 14 is further defined by the plurality of base segments 20, which extend along the curve or arcuate configuration, being collectively disposed in overlapping relation to one another as clearly demonstrated in FIGS. 1 through 3. This overlapping orientation of the plurality of base segments 20 is readily or automatically assumed due to the fact that they remain attached to the sidewalls while being disconnected from one another. Disconnection of the base segments 20 is accomplished by the severing of the links 22 and/or the contiguous, integral connections 24, as described above with reference to FIGS. 6 through 8.

Figure 4:
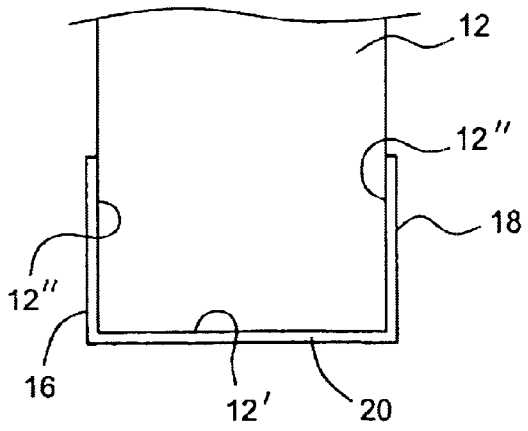
FIG. 4 is a transverse sectional view of the framing assembly of the present invention being connected to at least one of the plurality of framing studs associated with the curved wall or like structure being constructed.

Once the base 14 of the framing assembly 10 is oriented in the predetermined curvelinear configuration which defines the intended operative position, the plurality of studs 12 are disposed and supported thereon and/or attached thereto in predetermined spaced relation to one another so as to define the frame of the wall or like structure being constructed. With reference to FIG. 4, confronting engagement of a corresponding end of each of the studs 12 is accomplished by placement of the extremity or end surface 12' into confronting engagement with one or more of the overlapping base segments 20. Concurrently, oppositely disposed and spaced apart longitudinal surfaces 12" are disposed in confronting engagement and/or attachment to the perspective sidewall 16 and 18. In order to further facilitate the construction of a variety of different curved walls or like structures as well as to eliminate the requirement for customization of the framing assembly 10 on a job site, the base will be manufactured and made available in a variety of different sizes which correspond to the various sizes of the studs 12 The plurality of sizes will therefore include the recognized standard sizes used in the building and construction industry.

Therefore, an associated method of forming a curved wall and implementing the framing assembly of the present invention comprises establishing a predetermined length of the base 14 required to form the curved wall or like structure under construction. Subsequent to establishing the length of the base 14 the plurality of base segments 20 are separated from one another by severing or otherwise separating the links 22 or contiguous attachment portions 24, as indicated above with regard to FIGS. 6 through 8. In addition, various portions of the inner most sidewall 16 are separated from one another as at 16' and the base 14 is subsequently disposed, at least preliminarily, into a curved orientation which at least approximates the curvelinear configuration of the wall to be formed. The sidewall portions 16 are then adjusted such that the innermost sidewall 16 accurately assumes the proper, shortened longitudinal dimension and is arranged along an arc having a predetermined radius of curvature which, as set forth above, is significantly less than the radius of curvature of the outermost wall 18. A plurality of base segments 20 are then automatically disposed in the aforementioned overlapping relation to one another. Once the precise curvelinear configuration of the base 14 has been establish so as to correspond with the intended curvelinear configuration of the wall being formed, the plurality of sidewall portions 16' are fixedly attached to one another as described in detailed with reference to FIG. 5. The base 14, now oriented in its preferred operative position is mounted on, connected to or otherwise positioned on a supporting surface such as a flooring, sealing or the like. To this end, at least one embodiment of the present invention includes apertures 40 for the positioning of fasteners there through into attachment with the floor or other supporting surface on which the framing assembly is disposed. A plurality of studs 12 are then disposed in predetermined spaced relation to one another such that at least one end thereof is engaged within the base 14, while in its operative position. As such the corresponding end studs 12 are then disposed in confronting engagement and/or attachment to the plurality of overlapping base segments 20 as well as the oppositely disposed innermost and outer most sidewalls 16 and 18 respectfully as described in detailed with reference to FIG. 4. When such is accomplished, the framing of the curved wall or other structure can proceed in a somewhat conventional manner, such as by securing wall board or other facing material to the studs 12.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An assembly for framing a plurality of spaced apart studs in the construction of a curved wall, said assembly comprising:

a) a base having an elongated configuration and including two spaced apart sidewalls extending along the length of said base, b) said base comprising a plurality of base segments disposed in interconnecting relation between said sidewalls, c) said sidewalls extending outwardly from said base segments in substantially parallel relation to one another and in a common direction, d) said base disposable in an operative position at least partially defined by said sidewalls and said base segments disposed in a curved orientation substantially corresponding to the curved wall being constructed, e) at least one of said sidewalls being formed of a flexible and separable material, f) said operative position being further defined by said one sidewall separated along its length and oriented to define a predetermined shortened longitudinal dimension thereof, g) said plurality of base segments each being removably connected to a next adjacent one of said plurality of base segments, h) a plurality of links disposed in interconnecting relation to adjacent ones of said base segments, and i) said plurality of links being structured to removably interconnect adjacent ones of said plurality of base segments.

2. An assembly as recited in claim 1 wherein said plurality of links are formed of a separable material.

3. An assembly as recited in claim 1 wherein each of said sidewalls is formed of a flexible material.

4. An assembly as recited in claim 1 wherein said one sidewall is disposed inwardly of the other of said two sidewalls along the curved orientation of the curved wall.

5. An assembly as recited in claim 1 wherein said operative position is further defined at least some of said base segments being disconnected from one another and disposed in overlapping relation to one another when said base is disposed in the curved orientation substantially corresponding to the configuration of the curved wall being constructed.

6. An assembly as recited in claim 5 wherein said sidewalls and said plurality of base segments are disposed to respectively confront opposite longitudinal sides and a corresponding end portion of spaced apart ones of the plurality of studs.

7. An assembly for framing a plurality of spaced apart studs in the construction of a curved wall, said assembly comprising:

a) a base having an elongated configuration and including two spaced apart sidewalls extending along the length of said base, b) said base comprising a plurality of base segments disposed in interconnecting relation between said sidewalls, c) said sidewalls extending outwardly from said base segments in substantially parallel relation to one another and in a common direction, d) said base disposable in an operative position at least partially defined by said sidewalls and said base segments disposed in a curved orientation substantially corresponding to the curved wall being constructed, e) at least one of said sidewalls being formed of a flexible and separable material, f) said operative position being further defined by said one sidewall separated along its length and oriented to define a predetermined shortened longitudinal dimension thereof, g) said plurality of base segments each being removably connected to a next adjacent one of said plurality of base segments, h) said plurality of base segments are integrally and collectively secured to one another into an elongated array, at least a portion of each of said plurality of base segments being formed of a separable material, and i) said operative position being further defined by at least some of adjacent ones of said plurality of base segments being disconnected from one another.

8. An assembly as recited in claim 7 wherein said operative position is further defined by disconnected ones of said plurality of base segments disposed in overlapping relation to one another when said base is disposed in the curved orientation substantially corresponding to the configuration of the curved wall being constructed.

9. An assembly as recited in claim 8 wherein each of said plurality of base segments comprises a substantially circular configuration.

10. A method of framing a plurality of studs into a curved orientation in the construction of a curved wall, said method comprising:

a) establishing a predetermined length of a framing track having two commonly directed sidewalls interconnected to one another by a plurality of base segments, b) separating a plurality of portions of one of the two sidewalls from one another, c) disposing the plurality of separated portions in overlapping relation to one another to define a curved configuration having a predetermined radius of curvature, d) orienting the other of the two sidewalls into a curved configuration and in substantially parallel relation to the plurality of separated portions of the one sidewall, and e) positioning an end and corresponding longitudinal sides of each of the plurality of spaced apart studs into confronting engagement with the plurality of base segments and the two sidewalls respectively.

11. An assembly as recited in claim 10 comprising orienting the other of the two sidewalls into a curved configuration having a greater radius of curvature than said predetermined radius of curvature.

12. A method as recited in claim 10 comprising fixedly attaching adjacent ones of said plurality of separated portions into the overlapping relation to one another to fixedly define the predetermined radius of curvature of the one sidewall.

13. A method as recited in claim 10 comprising disposing said plurality of base segments in at least partially overlapping relation to one another dependent on the predetermined radius of curvature of the separated overlapping portions of the one sidewall.

14. A method as recited in claim 13 comprising disconnecting adjacent ones of the plurality of base segments prior to disposition thereof in the overlapping orientation.

* * * * *